US009200505B2

(12) United States Patent
Hytken

(10) Patent No.: US 9,200,505 B2
(45) Date of Patent: Dec. 1, 2015

(54) METHODS AND SYSTEMS FOR ENHANCED DELIVERY OF THERMAL ENERGY FOR HORIZONTAL WELLBORES

(75) Inventor: Kent Hytken, San Diego, CA (US)

(73) Assignee: Future Energy, LLC, Dayton, OH (US)

( * ) Notice: Subject to any disclaimer, the term of this patent is extended or adjusted under 35 U.S.C. 154(b) by 0 days.

(21) Appl. No.: 13/817,428

(22) PCT Filed: Aug. 18, 2011

(86) PCT No.: PCT/US2011/048325

§ 371 (c)(1),
(2), (4) Date: Aug. 12, 2013

(87) PCT Pub. No.: WO2012/024541

PCT Pub. Date: Feb. 23, 2012

(65) Prior Publication Data

US 2013/0312959 A1 Nov. 28, 2013

Related U.S. Application Data

(60) Provisional application No. 61/374,778, filed on Aug. 18, 2010.

(51) Int. Cl.
*E21B 43/24* (2006.01)

(52) U.S. Cl.
CPC ..... *E21B 43/2406* (2013.01)

(58) Field of Classification Search
CPC ..... E21B 43/255; E21B 43/385; C09K 5/12
USPC ..... 166/270.1, 272.3, 272.6, 272.7
See application file for complete search history.

(56) References Cited

U.S. PATENT DOCUMENTS

| | | | |
|---|---|---|---|
| 3,205,012 | A | 9/1965 | Dancy |
| 3,237,689 | A | 3/1966 | Justheim |
| 3,438,442 | A | 4/1969 | Pryor et al. |
| 3,493,050 | A | 2/1970 | Kelley et al. |

(Continued)

FOREIGN PATENT DOCUMENTS

| | | |
|---|---|---|
| GB | 1 228 437 | 4/1971 |

OTHER PUBLICATIONS

International Search Report and Written Opinion dated Jan. 27, 2012, relating to International Patent Application No. PCT/US2011/048325.

(Continued)

*Primary Examiner* — Angela M DiTrani
*Assistant Examiner* — Ashish Varma
(74) *Attorney, Agent, or Firm* — Dinsmore & Shohl LLP

(57) ABSTRACT

Systems and methods for delivery of thermal energy to horizontal wellbores are disclosed. In one embodiment, a method comprises heating a heat transfer fluid; circulating the heat transfer fluid into a vertical bore to a heat exchanger; advancing feedwater into the vertical bore to the heat exchanger, wherein the heat exchanger is configured to transfer heat from the heat transfer fluid to the feedwater to generate steam; transmitting the steam from the heat exchanger into a horizontal wellbore to cause heating of a subterranean region; and returning the heat transfer fluid from the heat exchanger to the surface. The method may further comprise collecting liquefied formation in a second horizontal wellbore; and transmitting the liquefied formation to the surface through a production line.

19 Claims, 8 Drawing Sheets

(56) References Cited

U.S. PATENT DOCUMENTS

| | | | | |
|---|---|---|---|---|
| 3,498,381 | A | 3/1970 | Earlougher | |
| 4,085,803 | A | 4/1978 | Butler | |
| 4,641,710 | A | 2/1987 | Klinger | |
| 4,671,351 | A | 6/1987 | Rappe | |
| 4,803,054 | A | 2/1989 | Sillerud et al. | |
| 5,040,605 | A | 8/1991 | Showalter | |
| 5,052,482 | A | 10/1991 | Gondouin | |
| 5,816,325 | A * | 10/1998 | Hytken | 166/303 |
| 7,147,057 | B2 * | 12/2006 | Steele et al. | 166/303 |
| 7,743,826 | B2 | 6/2010 | Harris et al. | |
| 7,798,221 | B2 | 9/2010 | Vinegar et al. | |
| 7,832,484 | B2 | 11/2010 | Nguyen et al. | |
| 7,841,408 | B2 | 11/2010 | Vinegar | |
| 7,845,411 | B2 | 12/2010 | Vinegar et al. | |
| 7,921,907 | B2 | 4/2011 | Burnham et al. | |
| 8,225,866 | B2 | 7/2012 | de Rouffignac et al. | |

OTHER PUBLICATIONS

Colombian first Office Action dated Dec. 7, 2013, relating to Columbian Patent Application No. 1352526.

International Preliminary Report on Patentability completed Jan. 10, 2012 pertaining to PCT/US2011/048325 filed Aug. 18, 2011.

Canadian Office Action dated Mar. 18, 2014 pertaining to Canadian Patent Application No. 2,808,416 filed Aug. 18, 2011.

Canadian Office Action dated Feb. 16, 2015 pertaining to Canadian Patent Application No. 2,808,416 filed Aug. 18, 2011.

* cited by examiner

METHODS AND SYSTEMS FOR ENHANCED DELIVERY OF THERMAL ENERGY FOR HORIZONTAL WELLBORES

CROSS REFERENCE TO RELATED APPLICATIONS

This application is related to and claims priority of U.S. Provisional Patent Application Ser. No. 61/374,778, filed Aug. 18, 2010, which is incorporated herein by reference in its entirety and for all purposes.

BACKGROUND OF THE INVENTION

The present invention relates generally to methods and systems for production of hydrocarbons from various subsurface formations.

Steam-assisted gravity drainage (SAGD) is used to recover hydrocarbons from a subsurface formation from fields where the hydrocarbons from a subsurface formation is extremely dense or has high viscosity. In this regard, steam from a horizontal wellbore is used to decrease the viscosity and to cause the hydrocarbons from a subsurface formation to drain into a second horizontal wellbore.

SUMMARY OF THE INVENTION

Various embodiments of the present invention provide for improved delivery of thermal energy, or heat, to increase the efficiency of recovery of hydrocarbons from a subsurface formation using horizontal wellbores.

In one aspect, the invention relates to a method comprising heating a heat transfer fluid; circulating the heat transfer fluid into a vertical bore to a heat exchanger; advancing feedwater into the vertical bore to the heat exchanger, wherein the heat exchanger is configured to transfer heat from the heat transfer fluid to the feedwater to generate steam; transmitting the steam from the heat exchanger into a horizontal wellbore to cause heating of a subterranean region; and returning the heat transfer fluid from the heat exchanger to the surface.

In another aspect, the invention relates to a system comprising a vertical bore; a heat exchanger positioned at a down-hole position of the vertical bore; a horizontal wellbore leading from the down-hole position of the vertical bore; a heat transfer fluid loop system for circulating heated heat transfer fluid into a vertical bore to the heat exchanger; a feedwater feed system to provide feedwater into the vertical bore to the heat exchanger, wherein the heat exchanger is configured to transfer heat from the heated heat transfer fluid to the feedwater to generate steam; wherein the steam is transmitted from the heat exchanger into the horizontal wellbore to cause heating of a subterranean region; and wherein the heat transfer fluid loop system is configured to return the heat transfer fluid from the heat exchanger to the surface.

In another aspect, the invention relates to a method comprising heating a heat transfer fluid; circulating the heat transfer fluid into a subterranean horizontal wellbore; advancing feedwater into the subterranean horizontal wellbore, wherein heat transfer from the heated heat transfer fluid to the feedwater generates steam for causing heating of a subterranean region; and returning the heat transfer fluid from the horizontal wellbore to the surface, wherein the horizontal wellbore is divided into a plurality of steam chambers, at least one of the steam chambers having a heat exchanger to facilitate transfer of heat from the heat transfer fluid to the feedwater.

In another aspect, the invention relates to a system comprising a subterranean horizontal wellbore; a heat transfer fluid loop system for circulating heated heat transfer fluid into the horizontal wellbore; a feedwater feed system to provide feedwater into the horizontal wellbore, wherein heat transfer from the heated heat transfer fluid to the feedwater generates steam for causing heating of a subterranean region; and wherein the heat transfer fluid loop system is configured to return the heat transfer fluid from the horizontal wellbore to the surface, and wherein the horizontal wellbore is divided into a plurality of steam chambers, at least one of the steam chambers having a heat exchanger to facilitate transfer of heat from the heat transfer fluid to the feedwater.

In another aspect, the invention relates to a method comprising heating a heat transfer fluid; circulating the heat transfer fluid into a subterranean horizontal wellbore; causing transfer of heat from the heat transfer fluid to a subterranean region; returning the heat transfer fluid from the horizontal wellbore to the surface, wherein the horizontal wellbore includes one or more heat exchangers to facilitate transfer of heat directly from the heat transfer fluid to the subterranean region.

In another aspect, the invention relates to a system comprising a subterranean horizontal wellbore; a heat transfer fluid loop system for circulating heated heat transfer fluid into the horizontal wellbore, wherein heat is transferred directly from the heated heat transfer fluid to a subterranean region; and wherein the heat transfer fluid loop system is configured to return the heat transfer fluid from the horizontal wellbore to the surface, and wherein the horizontal wellbore includes one or more heat exchangers to facilitate transfer of heat directly from the heat transfer fluid to the subterranean region.

Figure 1:
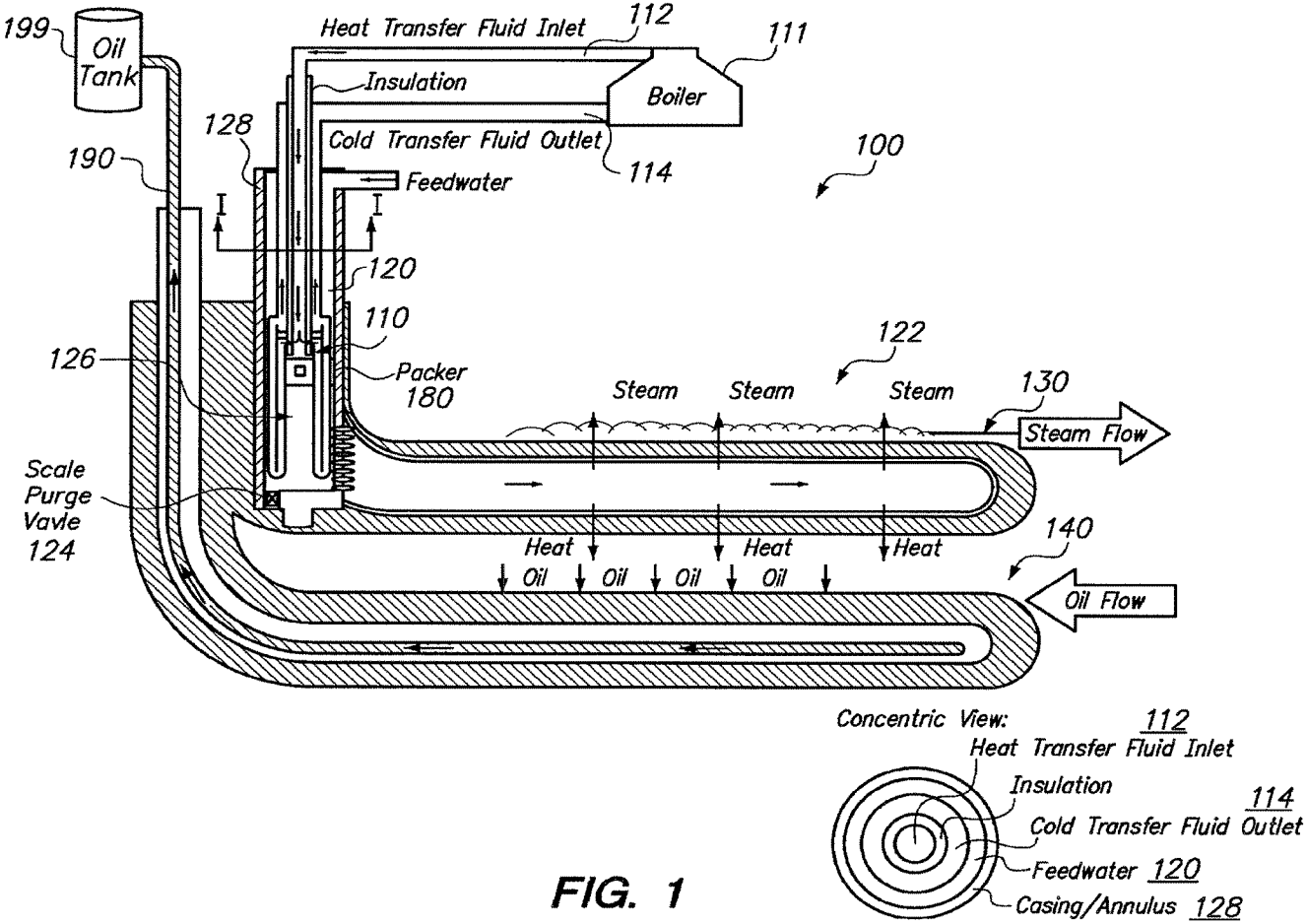
FIG. 1 is a cross-sectional view of a horizontal wellbore arrangement in accordance with an embodiment of the present invention.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations. Chemical and/or physical properties of hydrocarbon material in a subterranean formation may need to be changed to allow hydrocarbon material to be more easily removed from the subterranean formation. The chemical and physical changes may include in situ reactions that produce removable fluids, composition changes, solubility changes, density changes, phase changes, and/or viscosity changes of the hydrocarbon material in the formation. A heat transfer fluid may be, but is not limited to, a gas, a liquid, an emulsion, a slurry, and/or a stream of solid particles that has flow characteristics similar to liquid flow.

In some embodiments, an expandable tubular may be used in a wellbore. Expandable tubulars are described in, for example, U.S. Pat. No. 5,366,012 to Lohbeck and U.S. Pat. No. 6,354,373 to Vercaemer et al., each of which is incorporated by reference as if fully set forth herein.

Heaters may be placed in wellbores to heat a formation during an in situ process. Examples of in situ processes utilizing downhole heaters are illustrated in U.S. Pat. No. 2,634,961 to Ljungstrom; U.S. Pat. No. 2,732,195 to Ljungstrom; U.S. Pat. No. 2,780,450 to Ljungstrom; U.S. Pat. No. 2,789,805 to Ljungstrom; U.S. Pat. No. 2,923,535 to Ljungstrom; and U.S. Pat. No. 4,886,118 to Van Meurs et al.; each of which is incorporated by reference as if fully set forth herein.

Heat may be applied to the oil shale formation to pyrolyze kerogen in the oil shale formation. The heat may also fracture the formation to increase permeability of the formation. The increased permeability may allow formation fluid to travel to a production well where the fluid is removed from the oil shale formation.

A heat source may be used to heat a subterranean formation. Heaters may be used to heat the subterranean formation by radiation and/or conduction.

The heating element generates conductive and/or radiant energy that heats the casing. A granular solid fill material may be placed between the casing and the formation. The casing may conductively heat the fill material, which in turn conductively heats the formation.

In typical SAGD hydrocarbons from a subsurface formation recovery, the steam is generated on the surface and transmitted to the horizontal wellbore. The great distance traveled by the steam can result in degradation of the steam through heat loss. Thus, the steam that is delivered to the hydrocarbons from a subsurface formation field, for example, may not be a high-quality steam, resulting in reduced hydrocarbons from a subsurface formation recovery.

Embodiments of the present invention are directed to various methods and systems for recovering resources using horizontal wellbore in geological strata from a vertical position. The geological structures intended to be penetrated in this fashion may be coal seams, in situ gasification or methane drainage, or in hydrocarbons from a subsurface formation bearing strata for increasing the flow rate from a pre-existing wellbore. Other possible uses for the disclosed embodiments may be for use in the leaching of uranium ore from underground formation or for introducing horizontal channels for feedwater and steam injections, for example. Those skilled in the art will understand that the various embodiments disclosed herein may have other uses which are contemplated within the scope of the present invention.

Referring first to FIG. 1, a cross-sectional view of a horizontal wellbore arrangement 100 in accordance with an embodiment of the present invention is illustrated. In accordance with the arrangement 100 of FIG. 1, heat loss is reduced through the use of a down-hole heat exchange system 110. Certain embodiments of a down-hole heat exchanger 110 are described in greater detail below with reference to FIGS. 3 and 4. Of course, those skilled in the art will comprehend that embodiments of the present invention are not limited to use a particular heat exchanger and various other heat exchangers are contemplated within the scope of the present invention.

In accordance with the embodiment illustrated in FIG. 1, the down-hole heat exchange system 110 is positioned within a first wellbore 130. In various embodiments, the depth of the heat exchanger may be varied according to various factors, such as cost and environmental conditions. For example, in various embodiments, the depth of the first horizontal wellbore 130 may be between several hundred feet and several thousand feet.

In the embodiment of FIG. 1, the first wellbore 130 includes concentric strings formed to allow various fluids to flow therethrough. Feed feedwater is injected into the first wellbore 130 through a string 120. The down-hole heat exchange system 110 is configured to flash the hot feedwater into steam, and the steam is directed into the hydrocarbons from a subsurface formation through, for example, perforations in the wellbore 130. The perforations 180 are schematically illustrated in FIG. 1 at the entrance to the horizontal portion of the first wellbore 130. Steam is directed into the horizontal portion of the first wellbore 130, and into the geologic strata around the horizontal portion of the first wellbore 130.

The steam adds thermal energy to the hydrocarbons from a subsurface formation and serves to reduce the viscosity of the hydrocarbons from a subsurface formation deposit, causing the hydrocarbons from a subsurface formation to flow downward due to gravity. The downward flowing hydrocarbons from a subsurface formation are captured in a second wellbore, which is a production wellbore 140. The hydrocarbons from a subsurface formation captured in the production wellbore 140 are transported to one or more tanks 199 on the surface, for example, through a production line 190.

In the embodiment of FIG. 1, as wellbore as in the various other embodiments described herein, the horizontal wellbores and the various strings or pipes may be formed of coiled tubing. Coiled tubing is well known to those skilled in the art and refers generally to metal piping that is spooled on a large reel. Coiled tubing may have a diameter of between about one inch and about 3.25 inches. Of course, those skilled in the art will understand that the various embodiments are not limited to coiled tubing, nor to any particular dimensions of tubing.

Referring again to FIG. 1, a heated heat transfer fluid is delivered through a heat transfer fluid inlet string 112. In the illustrated embodiment, the heat transfer fluid inlet string 112 is the center-most string in the concentric configuration. The heated heat transfer fluid is provided from the surface to a position within the wellbore. The heated heat transfer fluid is pumped through the heat transfer fluid inlet string 112 at a very high flow rate to minimize loss of heat to the feedwater. In one embodiment, the heat transfer fluid inlet string 112 is a tube having a diameter of approximately 0.75 inches or more. In other embodiments, the heat transfer fluid inlet string 112 may be sized according to factors such as pump capability, distance between surface and the horizontal portion of the wellbore, and the type of heat transfer fluid, for example.

Additionally, hot feedwater is injected into a separate string 120 of the concentric configuration. The feedwater may be injected at a superheated temperature to maximize the thermal energy delivered to the hydrocarbons from a subsurface formation. In the illustrated embodiment, the hot feedwater string 120 is the outermost string in the concentric configuration.

At a certain depth of the wellbore, the heated heat transfer fluid in the heat transfer fluid inlet string 112 flashes the hot feedwater into high-quality steam which is directed into the first wellbore 130 (FIG. 1) through a wellbore 126 and perforations 180. A purging valve 124 may allow low-quality steam and scale to be directed into a sump.

After transfer of heat from the heat transfer fluid to the feedwater, the cooled transfer fluid is returned to the surface through a cold heat transfer fluid outlet string 114. A layer of insulation 128 may be provided between the heat transfer fluid inlet string 112 and the cold heat transfer fluid outlet string 114. In the concentric tubing configuration, the cold heat transfer fluid outlet string 114. In one embodiment, the concentric tubing configuration has an outer diameter of between 2.5 and 3 inches, and in a particular embodiment has an outer diameter of 2.875 inches, but can be larger depending on each concentric tubing configuration.

In certain embodiments, the heat transfer fluid may be circulated through a closed-loop system. In this regard, a heater may be configured to heat a heat transfer fluid to a high temperature. The heater may be positioned on the surface and is configured to operate on any of a variety of energy sources. For example, in one embodiment, the heater 111 operates using combustion of a fuel that may include natural gas, propane or methanol. The heater 111 can also operate on electricity.

The heat transfer fluid is heated by the heater to a very high temperature. In this regard, the heat transfer fluid should have a very high boiling point. In one embodiment, the heat transfer fluid is molten salt with a boiling temperature of approximately 1150° F. Thus, the heater heats the heat transfer fluid to a temperature as high as 1150° F. In other embodiments, the heat transfer fluid is heated to a temperature of 900° F. or another temperature. Preferably, the heat transfer fluid is heated to a temperature that is greater than 700° F.

A heat transfer fluid pump is preferably positioned on the cold side of the heater. The pump may be sized according to the particular needs of the system as implemented. Additionally, a reserve storage flask containing additional heat transfer fluid is included in the closed loop to ensure sufficient heat transfer fluid in the system.

The concentricity of the various strings in the first wellbore 130 is illustrated in the cross-sectional view illustrated in FIG. 1 and taken along I-I. In the illustrated embodiment, the hot heat transfer fluid is carried downward through an innermost string 112, and the cooled transfer fluid is returned upward through the second innermost string 114. A layer of insulation is provided between the two innermost strings to prevent heat transfer from the heated heat transfer fluid to the cooled transfer fluid being returned. Feed feedwater is carried downward through the outermost string 120. In this regard, the feed feedwater may absorb some residual heat from the cooled transfer fluid being returned.

Figure 2:
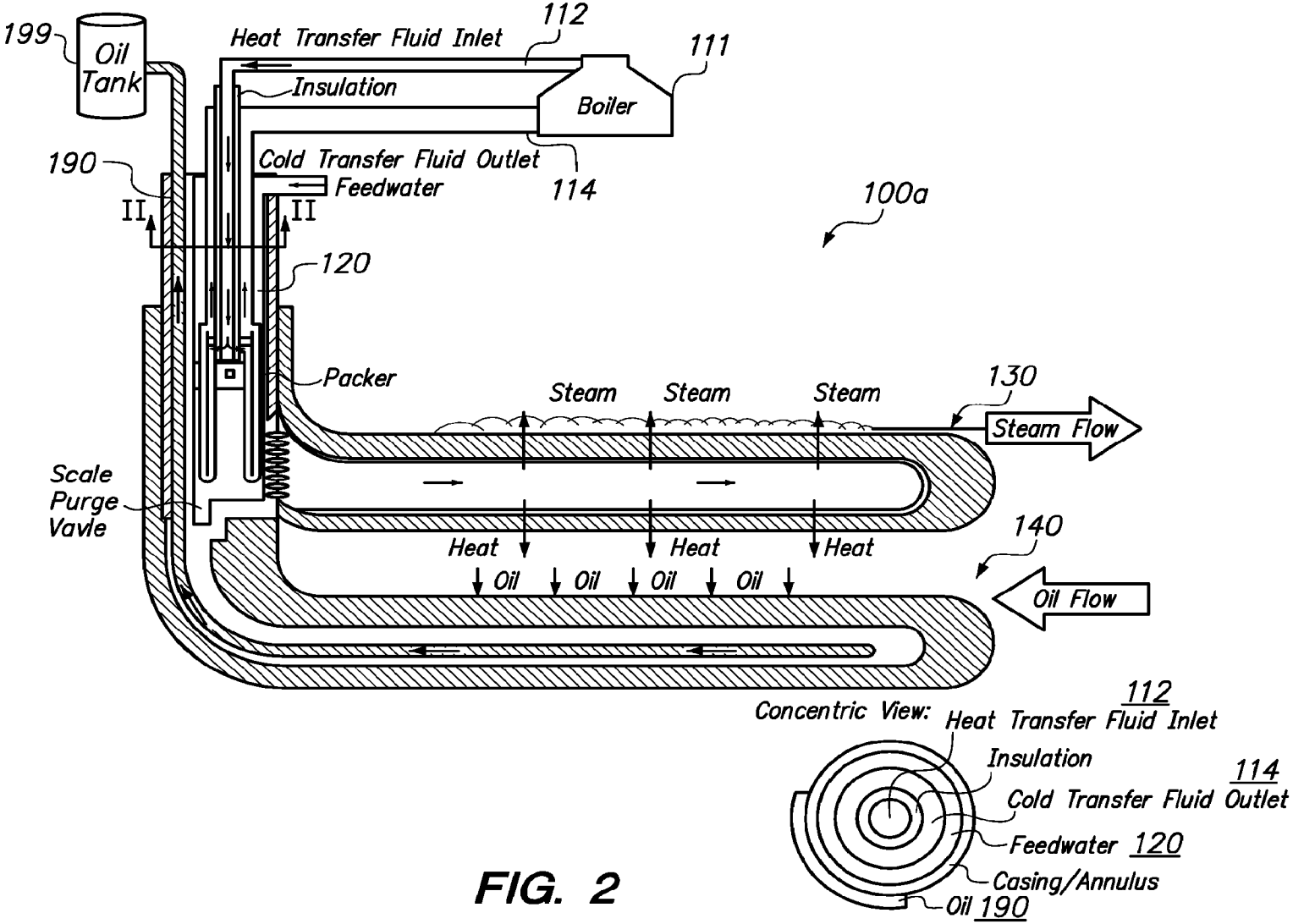
FIG. 2 is a cross-sectional view of a horizontal wellbore arrangement in accordance with another embodiment of the present invention.

Referring now to FIG. 2, a cross-sectional view of a horizontal wellbore arrangement 100*a* in accordance with another embodiment of the present invention is illustrated. The embodiment illustrated in FIG. 2 is similar to that illustrated in FIG. 1, but with a single wellbore bore. In this regard, a single vertical wellbore bore splits into two horizontal wellbores 130, 140. In this regard, the concentricity of the strings includes the production line 190, as illustrated in FIG. 2 and taken along II-II. In the illustrated embodiment, the hot heat transfer fluid is carried downward through an innermost string 112, and the cooled transfer fluid is returned upward through the second innermost string 114. A layer of insulation is provided between the two innermost strings to prevent heat transfer from the heated heat transfer fluid to the cooled transfer fluid being returned. Feed feedwater is carried downward through the third innermost string 120. Finally, the outmost string 190, which may only be partially concentric, is used to carry the produced resource to the surface.

Figure 3:
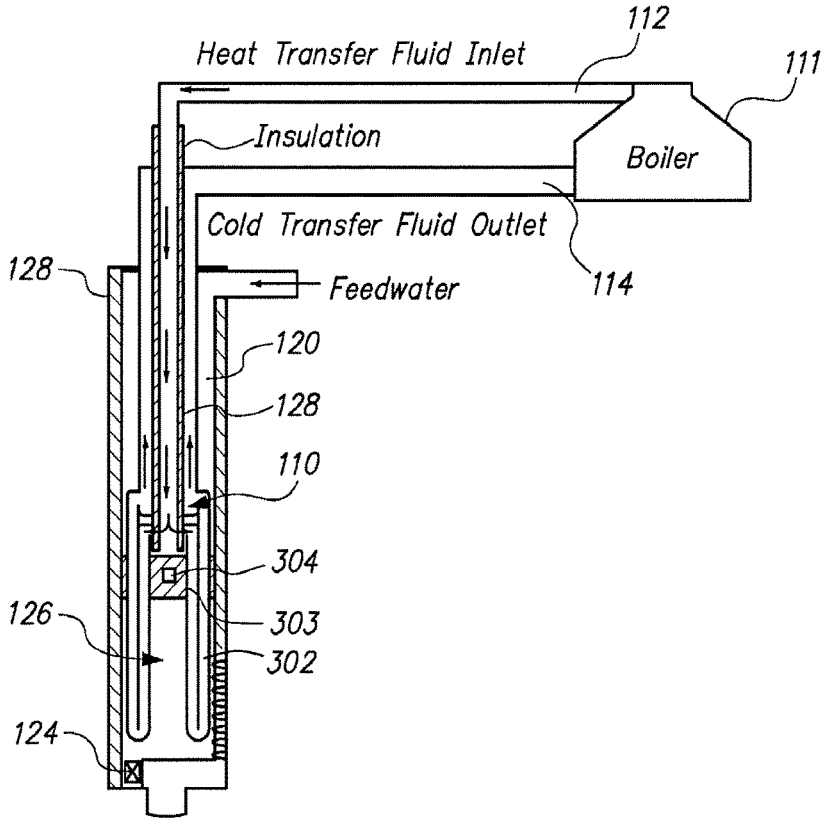
FIG. 3 is a schematic illustration of a down-hole heat exchanger.

Referring now to FIG. 3, a schematic illustration of a down-hole heat exchanger is illustrated. At the down-hole heat exchanger 110 shown in FIG. 3, inlet tubing 112 connects to a heat exchanger tubing 302 within a steam chamber portion 126 of the downhole heat exchanger 110. The heat transfer fluid from the inlet tubing 112 passes through heat exchanger tubing. Heat from heat exchanger tubing 302 vaporizes the feed feedwater in string 120 within steam chamber portion 126. Vapor enters the steam chamber portion 126 so that the steam is evenly distributed and maintained at high quality or even superheated by heat from the downward-extending heat exchanger tubing 302. After passing through downhole heat exchanger 110 and the heat exchanger tubing 302, return heat transfer fluid ascends in the an outlet tubing 114.

A packer assembly 303 with a feed valve 304 controls the rate of feedwater into downhole heat exchanger 110. In one embodiment, the feed valve 304 responds to the pressure differences between the feed feedwater at the base of the feed feedwater string 120 and the vapor pressure within the steam chamber portion 126 so that vapor quality is maintained at a high value.

In one embodiment, scale buildup on heat exchanger tubing 302 is reduced because of the narrow diameter of this tubing which causes the scale to periodically slough off. This sloughed-off scale may then build up at the base of heat exchanger 110. A purging valve 124 may be periodically opened to drain this accumulated scale into a sump of the wellbore.

Figure 4:
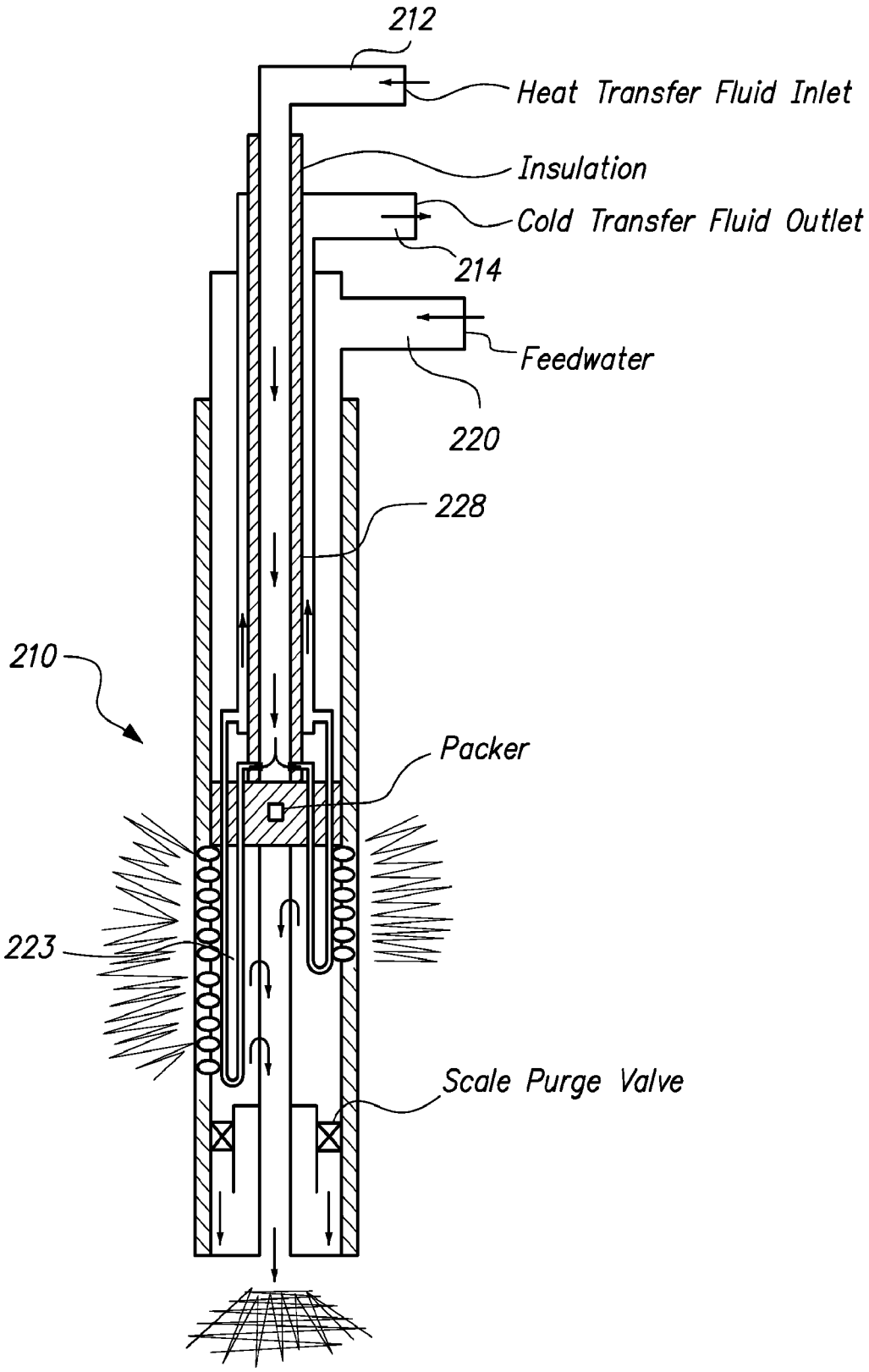
FIG. 4 is a schematic illustration of another embodiment of a down-hole heat exchanger.

Referring now to FIG. 4, a schematic illustration of another embodiment of a down-hole heat exchanger is illustrated. The down-hole heat exchanger 210 of FIG. 4 is similar to the down-hole heat exchanger 110 of FIG. 3. In the embodiment of FIG. 4, a line 223 containing hot heat transfer fluid may extend below the heat-exchange point. In this regard, heat transfer from the heat transfer fluid to the hot feedwater or steam may be provided deeper into the vertical bore of the wellbore.

Figure 5:
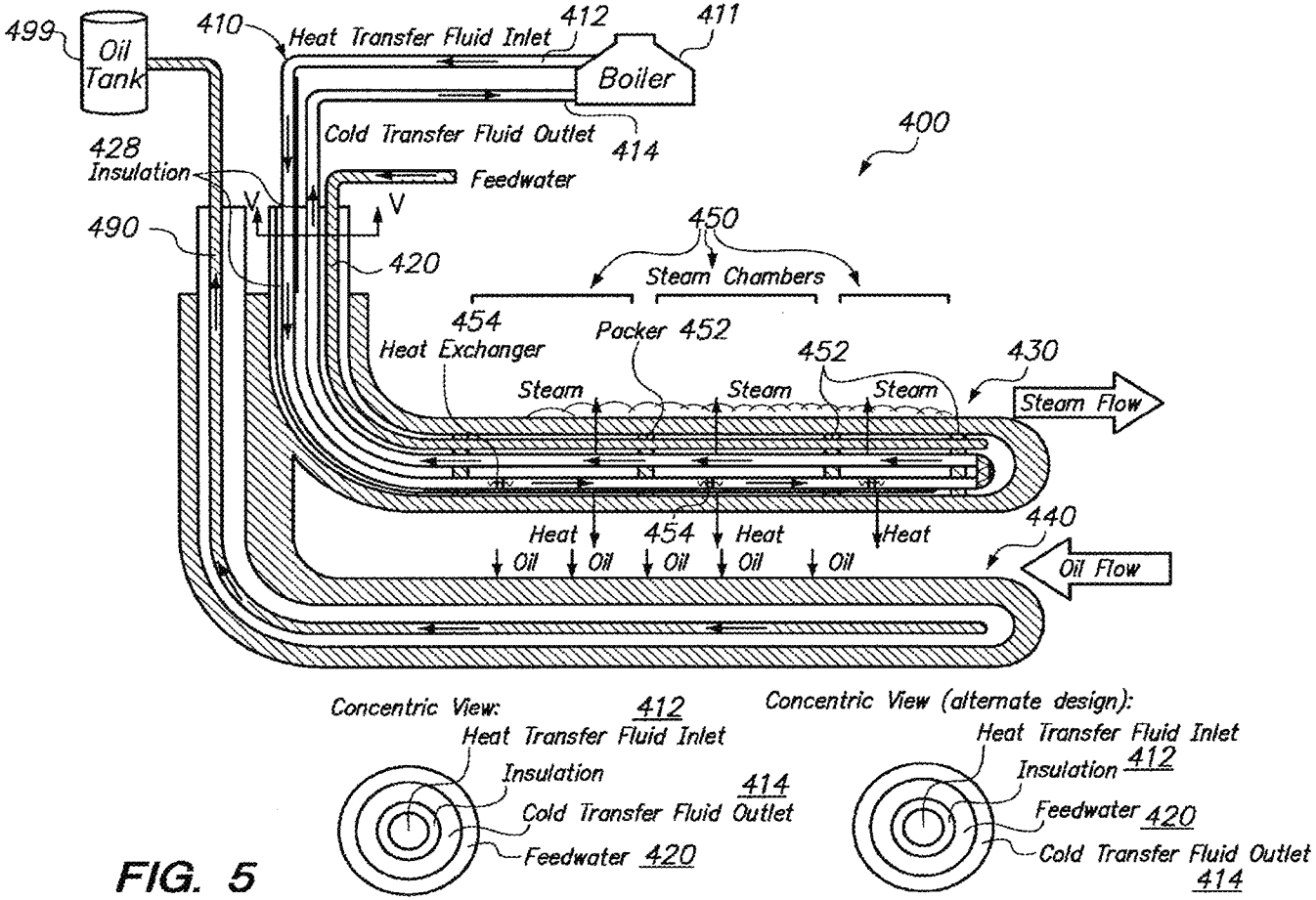
FIG. 5 is a cross-sectional view of a horizontal wellbore arrangement in accordance with another embodiment.

Referring now to FIG. 5, a cross-sectional view of a horizontal wellbore arrangement 400 in accordance with another embodiment of the present invention is illustrated.

In the embodiment of FIG. 5, a first wellbore 430 includes concentric strings formed to allow various fluids to flow therethrough. A heat transfer fluid is pumped into the first wellbore 430 through a closed loop system 410. Hot heat transfer fluid is pumped into the first wellbore 430 through a hot heat transfer fluid line 412, and cooled transfer fluid is returned through a return line 414. In order to minimize heat loss from the hot heat transfer fluid, insulation 428 may be provided between the hot heat transfer fluid line 412 and the return line 414. A boiler 411 heats the heat transfer fluid for pumping into the wellbore. The closed loop system 410 may include other components, such as a pump and a reservoir of heat transfer fluid. The heat transfer fluid circulates substantially through the entire length of the horizontal first wellbore 430.

Hot feedwater is pumped into the first wellbore 430 through a line 420. In the horizontal portion, the hot feedwater line 420 is positioned above the heat transfer fluid lines 412, 414. Heat transfer from the heat transfer fluid lines 412, 414 to the hot feedwater line 420 and flashed on the heat exchanger produces steam which is injected into the hydrocarbons from a subsurface formation deposit. Additionally, heat from the heat transfer fluid lines 412, 414 may be directly transferred to the hydrocarbon formation surrounding the first wellbore 430.

As noted above, the steam adds thermal energy to the hydrocarbons from a subsurface formation and serves to reduce the viscosity of the hydrocarbons from a subsurface formation, causing the hydrocarbons from a subsurface formation to flow downward due to gravity. The downward flowing hydrocarbons from a subsurface formation are captured in a second wellbore, which is a production wellbore 440. The hydrocarbons from a subsurface formation captured in the production wellbore 440 are transported to one or more tanks 499 on the surface, for example, through a production line 490.

The heated heat transfer fluid is pumped through the heat transfer fluid inlet string 412 at a very high flow rate to minimize loss of heat to the sea feedwater. In one embodiment, the heat transfer fluid inlet string 412 is a tube having a diameter of approximately 0.75 inches or more. In other embodiments, the heat transfer fluid inlet string 412 may be sized according to factors such as pump capability, distance between surface and the horizontal portion of the pump, and the type of heat transfer fluid, for example.

After transfer of heat from the heat transfer fluid to the feedwater, the cooled transfer fluid is returned to the surface through a cold heat transfer fluid outlet string 414. A layer of insulation 428 may be provided between the heat transfer fluid inlet string 412 and the cold heat transfer fluid outlet string 414. In the concentric configuration, the cold heat transfer fluid outlet string 414 is an annulus. In one embodiment, the annulus has an outer diameter of between 2.5 and 3 inches, and in a particular embodiment has an outer diameter of 2.875 inches.

The heat transfer fluid is heated by the heater to a very high temperature. In this regard, the heat transfer fluid should have a very high boiling point. In one embodiment, the heat transfer fluid is molten salt with a boiling temperature of approximately 1150° F. Thus, the heater heats the heat transfer fluid to a temperature as high as 1150° F. In other embodiments, the heat transfer fluid is heated to a temperature of 900° F. or another temperature. Preferably, the heat transfer fluid is heated to a temperature that is greater than 700° F. The heat transfer fluid deemed appropriate by those skilled in the art that may be injected into the wellbore such as diesel oil, gas oil, molten sodium, and synthetic heat transfer fluids, e.g., THERMINOL 59 heat transfer fluid which is commercially available from Solutia, Inc., MARLOTHERM heat transfer fluid which is commercially available from Condea Vista Co., and SYLTHERM and DOWTHERM heat transfer fluids which are commercially available from The Dow Chemical Company.

A heat transfer fluid pump is preferably positioned on the cold side of the heater 411. The pump may be sized according to the particular needs of the system as implemented. Additionally, a reserve storage flask containing additional heat transfer fluid is included in the closed loop to ensure sufficient heat transfer fluid in the system.

Various embodiments of the concentricity of the various strings in the first wellbore 430 are illustrated in the cross-sectional view illustrated in FIG. 5 and taken along V-V. In the illustrated embodiments, the hot heat transfer fluid is carried downward through an innermost string 412, and the cooled transfer fluid string 414 may be the second innermost ring, followed by the feedwater string 420. In another illustrated embodiment, the cooled transfer fluid string 414 and the feedwater string 420 may be switched. A layer of insulation is provided between the two innermost strings to prevent heat transfer from the heated heat transfer fluid.

In the embodiment illustrated in FIG. 5, the horizontal portion of the first wellbore 430 is divided into a plurality of steam chambers 450. The steam chambers are separated by packers 452 which contain a valve to facilitate equalization of steam pressure in each steam chamber 450. Further, each chamber 450 may include a heat exchanger 454 to facilitate transfer of heat between the heat transfer fluid in the inlet string 412 and the feed feedwater. The separation of the horizontal portion into a plurality of chambers 450, combined with the heat exchangers 454, improves the distribution and quality of steam in the horizontal portion, thereby increasing the production of hydrocarbons from a subsurface formation, for example. The heat exchangers may include heat exchanger tubing similar to the tubing 302 described above with reference to FIG. 3.

Figure 6:
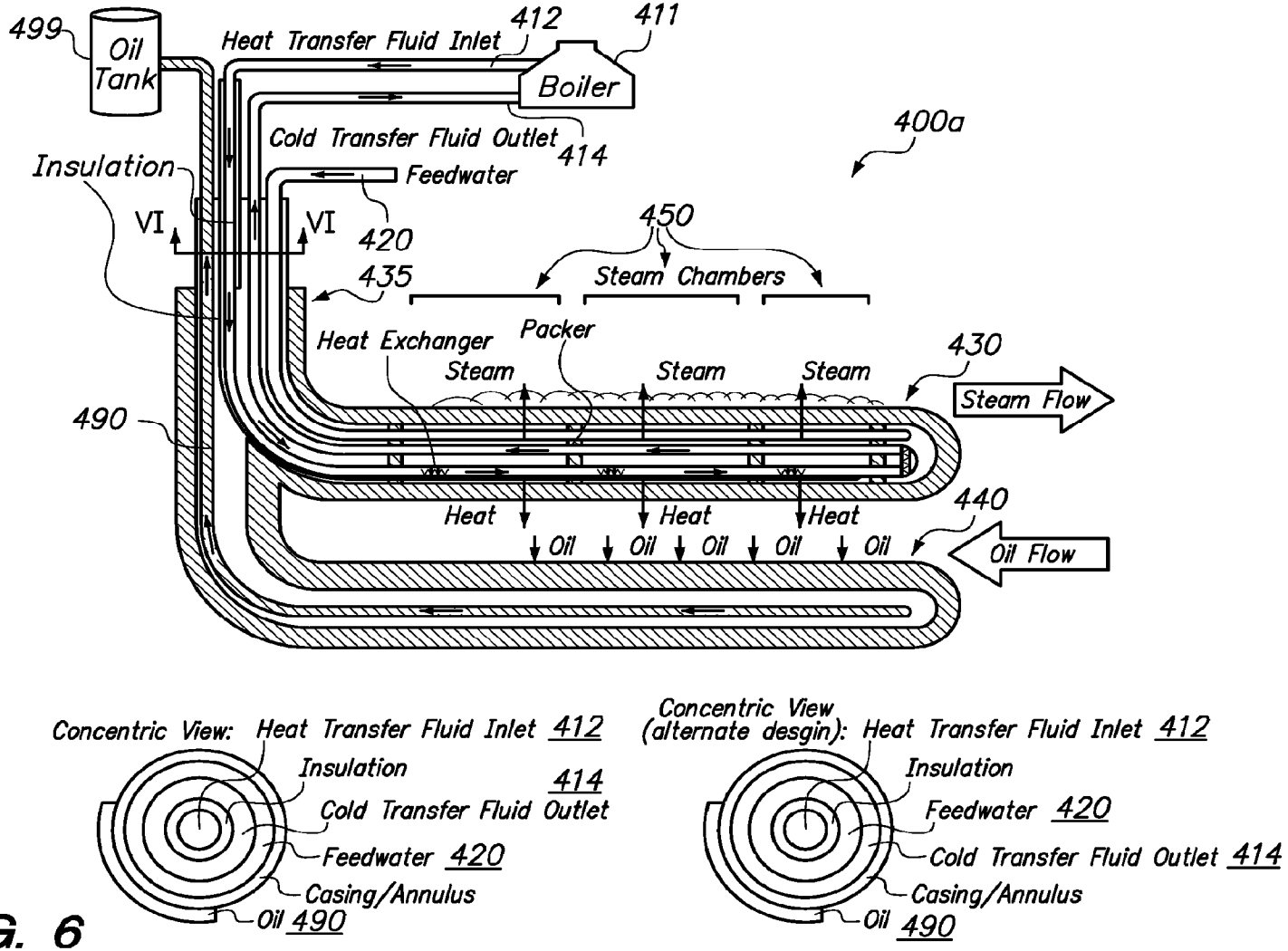
FIG. 6 is a cross-sectional view of a horizontal wellbore arrangement in accordance with another embodiment.

Referring now to FIG. 6, a cross-sectional view of a horizontal wellbore arrangement 400*a* in accordance with another embodiment of the present invention is illustrated. The embodiment illustrated in FIG. 6 is similar to that illustrated in FIG. 5, but with a single wellbore bore. In this regard, a single vertical wellbore bore splits into two horizontal wellbores 430, 440. In this regard, the concentricity of the strings includes the production line 490, as illustrated in FIG. 6 and taken along VI-VI. In the illustrated embodiment, the hot heat transfer fluid is carried downward through an innermost string 112, and the cooled transfer fluid and the feed feedwater are transported in the second and third strings. A layer of insulation is provided between the two innermost strings to prevent heat transfer from the heated heat transfer fluid. Finally, the outmost string 490, which may only be partially concentric, is used to carry the produced resource to the surface.

Figure 7:
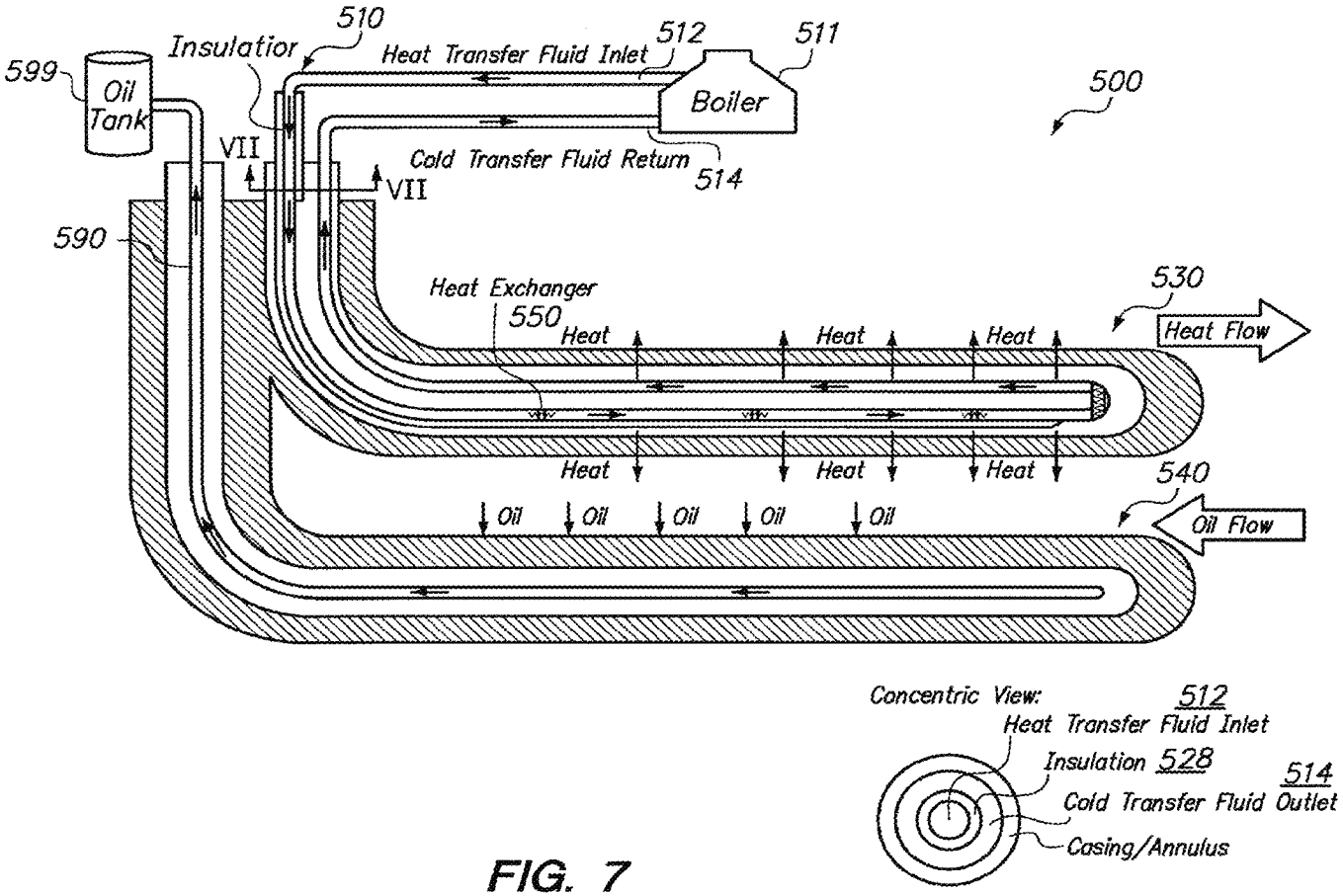
FIG. 7 is a cross-sectional view of a horizontal wellbore arrangement in accordance with another embodiment.

Referring now to FIG. 7, a cross-sectional view of a horizontal wellbore arrangement in accordance with another embodiment is illustrated. The horizontal wellbore arrangement 500 includes a first wellbore 530 for providing thermal energy to the hydrocarbons from a subsurface formation and a production wellbore 540 for delivering recovered hydrocarbons from a subsurface formation to the surface. In the embodiment of FIG. 7, the heat transfer fluid is pumped into the first wellbore 530 through a closed loop system 510. Hot heat transfer fluid is pumped into the first wellbore 530 through a hot heat transfer fluid line 512, and cooled transfer fluid is returned through a return line 514. In order to minimize heat loss from the hot heat transfer fluid, insulation 528 may be provided between the hot heat transfer fluid line 512 and the return line 514. A boiler 511 heats the heat transfer fluid for pumping into the wellbore. The closed loop system 510 may include other components, such as a pump and a reservoir of heat transfer fluid. The heat transfer fluid circulates substantially through the entire length of the horizontal first wellbore 530.

In the embodiment of FIG. 7, there is no need for hot feedwater to be injected into the wellbore. Instead, thermal energy by conductive and/or ambient heat is directly transferred from the heat transfer fluid lines 512, 514 to the hydrocarbons from a subsurface formation surrounding the first wellbore 530. In this regard, the hydrocarbons from a subsurface formation captured by the production wellbore 540 have a significantly higher hydrocarbon-to-feedwater ratio. The horizontal wellbore includes heat exchangers 550 to facilitate the direct transfer of conductive and/or ambient heat from the heat transfer fluid to the hydrocarbons from a subsurface formation deposit.

The concentricity of the various strings in the first wellbore 530 is illustrated in the cross-sectional view illustrated in FIG. 7 and taken along VII-VII. In the illustrated embodiment, the hot heat transfer fluid is carried downward through an inner string 512, and the cooled transfer fluid is returned upward through the outer string 514. A layer of insulation is provided between the two strings to prevent heat transfer from the heated heat transfer fluid to the cooled transfer fluid being returned.

Figure 8:
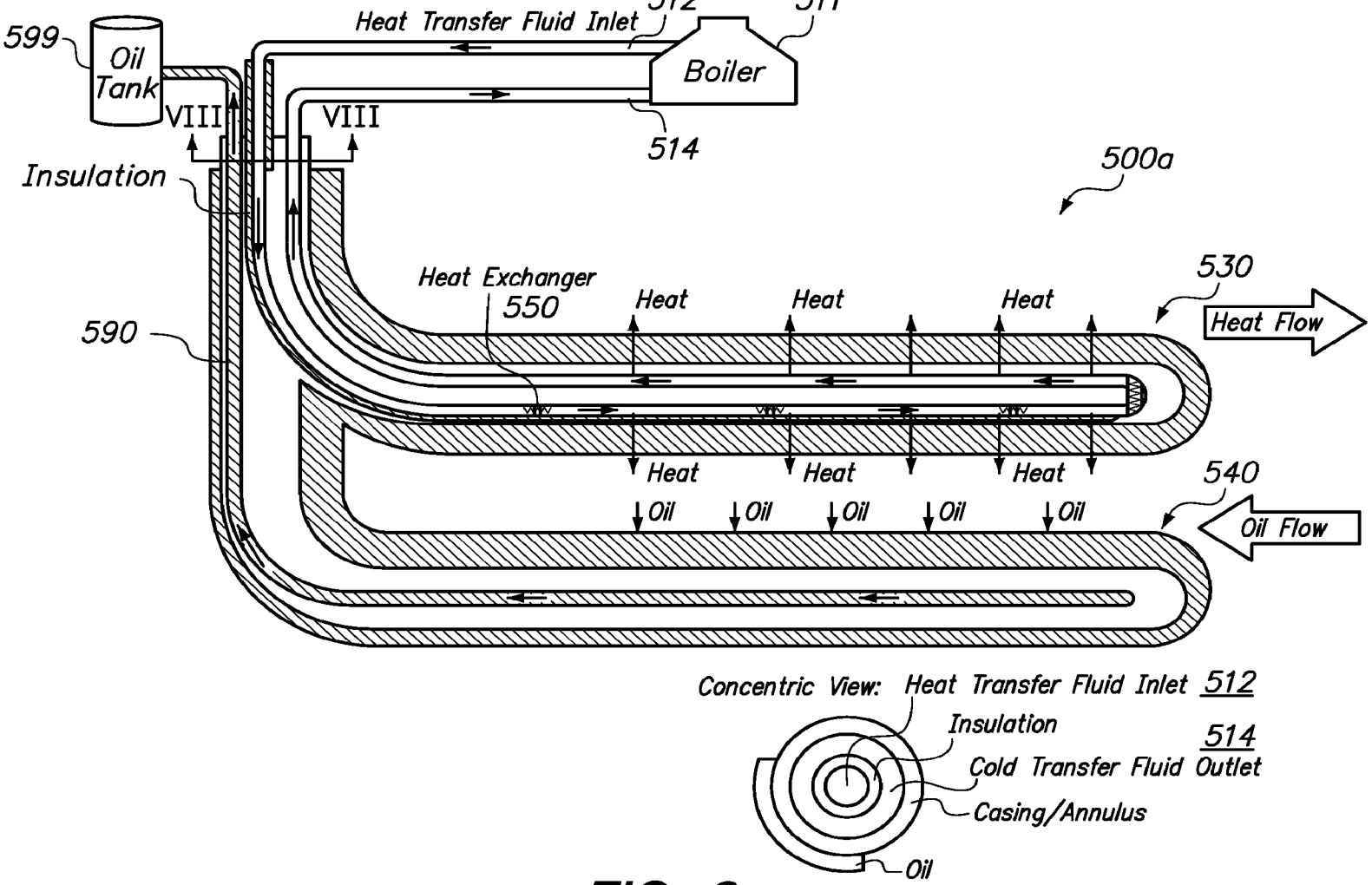
FIG. 8 is a cross-sectional view of a horizontal wellbore arrangement in accordance with another embodiment.

Referring now to FIG. 8, a cross-sectional view of a horizontal wellbore arrangement 500*a* in accordance with another embodiment of the present invention is illustrated. The embodiment illustrated in FIG. 8 is similar to that illustrated in FIG. 7, but with a single wellbore bore. In this regard, a single vertical wellbore bore splits into two horizontal wellbores 530, 540. In this regard, the concentricity of the strings includes the production line 590, as illustrated in FIG. 8 and taken along VIII-VIII. In the illustrated embodiment, the hot heat transfer fluid is carried downward through an inner string 512, and the cooled transfer fluid is transported in an outer string. A layer of insulation is provided between the two strings to prevent heat transfer from the heated heat transfer fluid. Finally, the outermost string 590, which may only be partially concentric, is used to carry the produced resource to the surface.

Thus, embodiments described herein generally relate to systems, methods, and heaters for treating a subsurface formation. Embodiments described herein also generally relate to heaters that have novel components therein. Such heaters can be obtained by using the systems and methods described herein.

In certain embodiments, the invention provides one or more systems, methods, and/or heaters. In some embodiments, the systems, methods, and/or heaters are used for treating a subsurface formation.

In some embodiments, an in situ heat treatment system for producing hydrocarbons from a subsurface formation includes a plurality of wellbores in the formation; piping positioned in at least two of the wellbores; a fluid circulation system coupled to the piping; and a heat supply configured to heat a heat transfer fluid continually circulated through the piping to heat the temperature of the formation to temperatures that allow for hydrocarbon production from the formation.

In some embodiments, a method of heating a subsurface formation includes heating a heat transfer fluid using heat exchange with a heat supply; continually circulating the heat transfer fluid through piping in the formation to heat a portion of the formation to allow hydrocarbons to be produced from the formation; and producing hydrocarbons from the formation.

In some embodiments, a method of heating a subsurface formation includes passing a heat transfer fluid from a surface boiler to a heat exchanger; heating the heat transfer fluid to a first temperature; flowing the heat transfer fluid through a heater section to a sump, wherein heat transfers from the heater section to a treatment area in the formation; gas lifting the heat transfer fluid to the surface from the sump; and returning at least a portion of the heat transfer fluid to the vessel.

In further embodiments, features from specific embodiments may be combined with features from other embodiments. For example, features from one embodiment may be combined with features from any of the other embodiments.

In further embodiments, treating a subsurface formation is performed using any of the methods, systems, or heaters described herein.

In further embodiments, additional features may be added to the specific embodiments described herein.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and its practical application to enable one skilled in the art to utilize the present invention in various embodiments and with various modifications as are suited to the particular use contemplated. The features of the embodiments described herein may be combined in all possible combinations of methods, apparatus, modules, systems, and computer program products.

What is claimed is:

1. A method for delivery of thermal energy to a horizontal wellbore located in a subterranean formation via a connected vertical bore, comprising:

heating a heat transfer fluid in a heater positioned on the surface;

circulating the heat transfer fluid from the heater into the vertical bore and downward through an innermost first string of a concentricity of strings to a heat exchanger located in the horizontal wellbore and upward from the heat exchanger to the surface through a second string of the concentricity of strings; and generating steam in the horizontal wellbore by advancing feedwater from the surface and into the vertical bore through a third string of the concentricity of the strings to a steam chamber located and separated by packers in the horizontal wellbore and which includes therein the heat exchanger, wherein tubing of the heat exchanger transfers heat from the heat transfer fluid to the feedwater, flashing the feedwater into steam in the steam chamber, thereby causing heating of the subterranean formation via the thermal energy added by the steam from the steam chamber.

2. The method of claim 1, wherein the heat transfer fluid is heated using a gas burning or zero emissions electric boiler.

3. The method of claim 1, wherein the heat transfer fluid comprises one or more of the following: diesel oil, gas oil, molten sodium, molten salt, or a synthetic heat transfer fluid.

4. The method of claim 1, further comprising:

providing an oil production line in a second horizontal wellbore; and collecting and transmitting liquefied oil deposits located in the second horizontal wellbore to the surface through the oil production line.

5. The method of claim 4, wherein the oil production line extends to the surface along either the vertical bore or a second vertical bore.

6. The method of claim 1, wherein the concentricity of the strings includes an oil production line, and said method further comprises collecting and transmitting liquefied oil deposits located in the horizontal wellbore to the surface through the oil production line.

7. The method of claim 1, further comprises heating the heat transfer fluid to a temperature that is greater than 700° F. and to as high as 1150° F.

8. A system for delivery of thermal energy to a horizontal wellbore located in a subterranean formation via a connected vertical bore, comprising:

a heater positioned on the surface to heat a heat transfer fluid;

a steam chamber separated by packers and positioned at a down-hole position of the horizontal wellbore, said steam chamber having a heat exchanger;

a heat transfer fluid loop system which comprises concentric strings for flow of heated heat transfer fluid, cooled transfer fluid and feedwater, wherein an innermost first string and a second string of the concentric strings connect the heater to heat exchanger to supply the heated heat transfer fluid through the wellbores to the heat exchanger and return the cooled transfer fluid from the heat exchanger to the heater; and a feedwater system connected to a third string of the concentric strings to provide feedwater from the surface into the vertical bore and to the steam chamber, wherein the heat exchanger has tubing to transfer heat from the heated heat transfer fluid to the feedwater to generate steam in the steam chamber and cause heating of a subterranean region via the thermal energy added by the steam from the steam chamber.

9. The system of claim 8, further comprising:

a second horizontal wellbore to collect liquefied oil deposits; and an oil production line which transmits the liquefied oil deposits to the surface.

10. The system of claim 9, wherein the oil production line extends to the surface along either the vertical bore or a second vertical bore.

11. The system of claim 8, wherein the heat transfer fluid is diesel oil, gas oil, molten sodium, molten salt, or a synthetic heat transfer fluid.

12. The system of claim 8, wherein the concentric strings includes an oil production line.

13. The system of claim 8, wherein the horizontal wellbore is further divided into steam chambers in which the steam chambers each have a heat exchanger to facilitate transfer of heat from the heat transfer fluid to the feedwater.

14. The system of claim 8, wherein an outermost string of the concentric strings is partially concentric.

15. The system of claim 8, wherein insulation is provided to the innermost first string.

16. The system of claim 8, wherein the steam chambers are separated by packers having valves to control the flow of steam between the steam chambers.

17. The system of claim 8, wherein heater heats the a heat transfer fluid to a temperature that is greater than 700° F. and to as high as 1150° F.

18. A system for delivery of thermal energy to a horizontal wellbore located in a subterranean formation via a connected vertical bore, comprising:

a heater positioned on the surface to heat a heat transfer fluid;

a steam chamber separated by a packer assembly and positioned at a down-hole position of the vertical bore, said steam chamber having a heat exchanger and perforations to direct steam from the steam chamber into the horizontal wellbore;

a heat transfer fluid loop system which comprises concentric strings for flow of heated heat transfer fluid, cooled transfer fluid and feedwater, wherein an innermost first string and a second string of the concentric strings connect the heater to heat exchanger to supply the heated heat transfer fluid through the vertical bore to the heat exchanger and return the cooled transfer fluid from the heat exchanger to the heater; and a feedwater system connected to a third string of the concentric strings to provide feedwater from the surface into the vertical bore and to the steam chamber, wherein the heat exchanger has tubing which transfers heat from the heated heat transfer fluid to the feedwater to generate steam in the steam chamber and cause heating of a subterranean region via the thermal energy added by the steam from the steam chamber being directed into the horizontal wellbore through the vertical bore and perforations.

19. The system of claim 18, wherein heater heats the a heat transfer fluid to a temperature that is greater than 700° F. and to as high as 1150° F.

* * * * *